US008091498B2

(12) United States Patent
Lehmann

(10) Patent No.: US 8,091,498 B2
(45) Date of Patent: Jan. 10, 2012

(54) RUDDER ARRANGEMENT FOR SHIPS HAVING HIGHER SPEEDS COMPRISING A CAVITATION-REDUCING TWISTED, IN PARTICULAR BALANCED RUDDER

(75) Inventor: Dirk Lehmann, Winsen (DE)

(73) Assignee: becker marine systems GmbH & Co. KG, Hamburg (DE)

( * ) Notice: Subject to any disclaimer, the term of this patent is extended or adjusted under 35 U.S.C. 154(b) by 0 days.

(21) Appl. No.: 12/284,898

(22) Filed: Sep. 25, 2008

(65) Prior Publication Data

US 2010/0037809 A1 Feb. 18, 2010

(30) Foreign Application Priority Data

Aug. 13, 2008 (DE) ..... 20 2008 010 759 U
Sep. 11, 2008 (DE) ..... 20 2008 012 125 U

(51) Int. Cl.
*B63H 25/06* (2006.01)

(52) U.S. Cl. ..... 114/162

(58) Field of Classification Search ..... 114/162–169, 114/144 R; 440/51
See application file for complete search history.

(56) References Cited

U.S. PATENT DOCUMENTS 1,670,997 A * 5/1928 Tutin ..... 114/162
2,331,706 A * 10/1943 Livingston ..... 114/162
3,120,208 A * 2/1964 Macleay ..... 114/245
3,442,244 A * 5/1969 Corlett et al. ..... 114/163
5,752,865 A * 5/1998 Ishii et al. ..... 440/67
7,661,379 B2 * 2/2010 Pettersson et al. ..... 114/162
7,717,052 B2 * 5/2010 Kluge et al. ..... 114/165
2008/0110386 A1 * 5/2008 Kluge et al. ..... 114/162

FOREIGN PATENT DOCUMENTS

DE 20 2004 021 500 U1 7/2008
EP 1 857 358 A2 11/2007
GB 332 082 7/1930
GB 332082 7/1930
JP 58030896 2/1983

OTHER PUBLICATIONS

Dictionary of Nautical Words and Terms, Edition revised by Captain A.G.W. Miller, copyright 1998 by Brown, Son & Ferguson, Ltd. Glasgow, Scotland, Great Britain G412SD (p. 34—balanced rudder).*

European Patent Office, European Search Report for EP 08 01 6049, issued Feb. 4, 2009.

Danish Patent and Trademark Office, Singapore Examination Report for 2008071490-9, issued Feb. 2, 2010.

* cited by examiner

*Primary Examiner* — Daniel Venne
(74) *Attorney, Agent, or Firm* — Kelly Lowry & Kelley, LLP

(57) ABSTRACT

The rudder arrangement for ships comprises a twisted and balanced rudder blade having a slender profile and a low profile thickness and comprising a propeller facing the rudder blade. A rudder pipe is located in the upper region of the rudder blade with rudder post located therein, wherein the rudder blade comprises two superposed rudder blade sections having different heights whose front nose strips facing the propeller are offset in such a manner that one nose strip is offset to port or starboard and the other nose strip is offset to starboard or port. The two side wall surfaces of the rudder blade converge into an end strip facing away from the propeller and have different arc profiles.

21 Claims, 15 Drawing Sheets

RUDDER ARRANGEMENT FOR SHIPS HAVING HIGHER SPEEDS COMPRISING A CAVITATION-REDUCING TWISTED, IN PARTICULAR BALANCED RUDDER

BACKGROUND OF THE INVENTION

1. Field of the Invention

This invention relates to a rudder design for ships traveling at high speeds for reduction of cavitation by using a twisted and balanced rudder (100). The rudder (100) is associated with a propeller (115) arranged on a drivable propeller axis (PA), where the rudder (100) is connected to a rudder post (140).

2. Description of the Related Art

Ships' rudders, such as balanced rudders or balanced profile rudders—with or without a linked fin, are known in various embodiments. Also known are ships' rudders having a twisted rudder blade consisting of two superposed rudder blade sections, whose nose strips facing the propeller are laterally offset in such a manner that one nose strip is offset to port and the other nose strip is offset to starboard.

Thus, JP(A) Sho 58-30896 describes a rudder for ships having a twisted rudder blade consisting of an upper and a lower part, wherein both parts are twisted in their directions facing the propeller. More specifically, the rudder is twisted in such a manner that only the regions of the two parts relating to the nose strips are laterally offset. Whereas the regions extending to the end strips of the two parts have the same cross-sectional profiles and the same cross-sectional dimensions.

GB 332,082 likewise discloses a ships' rudder having a twisted rudder blade whose profile regions facing the propeller, namely the nose strips to starboard and port, are laterally flared and where the nose strips are configured to taper to a tip. The cross-sectional profiles of the two rudder blade sections are configured so that the side wall surfaces of the two rudder blade sections located on the port and starboard side run free from curvature and rectilinearly between the end strips to each laterally bent nose strips so that the side wall surfaces have no outwardly curved regions having different radii of curvature. In addition, the profile configuration of the rudder blade is such that the two cross-sectional surfaces of the two rudder blade surfaces located one above the other are the same size and extend over the entire height of the rudder blade. Due to the nose strips tapering to a peak, sharp-edged indentations are formed, which are exposed to cavitation and destruction. An improvement in the propulsion is achieved with the new rudder configuration disclosed in this specification.

The speeds of modern ships are continually increasing. As a result of the fast flowing water velocities associated with the higher speeds of modern ships, the loading on the propeller and on the rudder is increasing. The symmetry of the profile of previous rudder blade designs creates under-pressure zones on the rudder surface which then leads to cavitation and eventual erosion. Cavitation takes place on those points of the rudder blade at which the flow is extremely accelerated. In this case, the strong rotational water flow of the propeller impacts on the rudder blade surface at high speed. As a result of this strong acceleration, the static pressure drops below the vapor pressure of the water, resulting in the formation of vapor bubbles which abruptly implode. These implosions lead to destruction of the rudder blade surface. This results in expensive repairs and frequently new rudder blades must be used.

SUMMARY OF THE INVENTION

It is the object of the present invention to provide a rudder arrangement for ships having large and very large dimensions. In particular a balanced rudder blade having a twisted rudder leading edge is disclosed in which erosion effects on the rudder blade due to cavitation formation are reduced. When used in fast ships having highly loaded propellers, cavitation can be reduced or avoided with a rudder and rudder post mounting design in which the rudder pipe drawn into the rudder blade leads the rudder forces directly into the ships' hull via a collar bearing integrated at the bottom. In this configuration, the cantilever forces on the rudder post produce pure bending stress without any torsional moments. In addition, the forces acting on the rudder blade in its lower region, said forces being generated by the propeller current having very high flow velocities, are to be intercepted and the rudder blade balanced out without any damage occurring to the bearing for the rudder post.

This object is achieved in a rudder arrangement according to the type described initially as a result of the functional cooperation of a twisted balanced rudder blade with a special rudder post mounting having the following features.

According to the invention, the rudder arrangement consists of a balanced rudder blade preferably having a slender profile with a small profile thickness, comprising two superposed rudder blade sections having the same or different heights. Preferably the balanced rudder blade comprises a lower rudder blade section having a smaller height compared with the height of the upper rudder blade section and comprising nose strips facing the propeller. The nose strips have an approximately semicircular profile, which are positioned in such a manner that one nose strip is offset to port BB or starboard SB and the other nose strip is laterally offset in the other direction to either the starboard SB or port BB with respect to the longitudinal central line LML of the rudder blade. The side wall surfaces of the two rudder blade sections converge into an end strip facing away from the propeller.

In an exemplary embodiment the two nose strips and the end strip run downwards in a conically tapering manner accompanied by a reduction in the cross-sectional areas from the upper region OB to the lower region UB of the rudder blade.

In another exemplary embodiment the end strip runs rectilinearly and parallel to the rudder post and the two nose strips run downwards in a conically tapering manner accompanied by a reduction in the cross-sectional areas from the upper region OB to the lower region UB.

In an exemplary embodiment the cross-sectional surface sections of the upper rudder blade section and the lower rudder blade section in the region between the end strip and the greatest profile thickness PD of the rudder blade have a length L, which corresponds to at least 1½ times the length L1 of the cross-sectional surface sections of the upper rudder blade section and the lower rudder blade section between the greatest profile thickness PD of the rudder blade and the nose strips.

In another exemplary embodiment the upper rudder blade section, on the port side BB and the lower rudder blade section on the starboard side SB, each comprise a side wall section running in a slightly arcuate manner and extending from the nose strips in the direction of the end strip, having a length L2 which extends over the length L'2 of the side wall sections from the nose strips as far as the greatest profile thickness PD plus a length L"2 which corresponds to at least ⅓ of the length L'2. The side wall section running in a slightly arcuate manner is adjoined by the rectilinearly running side wall section which ends in the end strip.

In another exemplary embodiment the upper rudder blade section on the port side BB and the lower rudder blade section on the starboard side SB each comprise a highly curved side wall section running in an arcuate manner and extending from the nose strips in the direction of the end strip, having a length L3 which extends over the length L'3 of the side wall sections from the nose strips as far as the greatest profile thickness PD plus a length L"3 which corresponds to at least ⅓ of the length L'3. The highly curved side wall section running in an arcuate manner is adjoined by the rectilinearly running side wall section which ends in the end strip.

In another exemplary embodiment the two rectilinearly running side wall sections have the same lengths in pairs and the cross-sectional surface sections located between the two side wall sections are the same size and are configured symmetrically.

In another exemplary embodiment the distance between the side wall section running in a slightly arcuate manner from the longitudinal central line LML is greater than the distance between the highly arcuately running side wall section from the longitudinal central line LML. The cross-sectional surface sections located between the two side wall sections running in a slightly arcuate manner on both sides of the longitudinal central line LML are configured asymmetrically.

Also included is a rudder post cooperating functionally with the rudder blade, having at least one bearing.

The rudder post (in particular made of forged steel or another suitable material) together with the rudder pipe receiving said post (in particular made of forged steel or another suitable material) is arranged in the area of the greatest profile thickness PD the upper rudder blade section therein and extends with its end fastening device over the entire height of the upper rudder blade section.

The rudder pipe for the rudder post which is drawn deeply into the upper rudder blade section as a cantilever is provided with a central longitudinal hole for receiving the rudder post.

The ruder pipe cross-section is designed as thin-walled and the rudder pipe preferably has a collar bearing on the inner wall side in the area of its free end for mounting the rudder post, and wherein in its end region the rudder post is, and the end of this section is, connected to the upper rudder blade section.

The cross-sectional surface sections of the respective upper and lower rudder blade sections are herein described at various times as either "in a region between the end strip and an area of greatest profile thickness of the rudder blade", i.e., the rear, or "between the area of greatest profile thickness of the rudder blade and the nose strip", i.e., the front. For ease of reference, the cross-sectional surface section of the upper rear rudder blade is herein referred to as a first cross-sectional surface section. The cross-sectional surface section of the upper front rudder blade is herein referred to as a second cross-sectional surface section. The cross-sectional surface section of the lower rear rudder blade is herein referred to as a third cross-sectional surface section. The cross-sectional surface section of the lower front rudder blade is herein referred to as a fourth cross-sectional surface section.

The curved arcuate side wall sections of the respective upper and lower rudder blade sections are herein described at various times as slightly curved arcuate side wall sections and/or highly curved arcuate side wall sections. For ease of reference, the slightly curved arcuate side wall section of the upper rudder blade section is herein referred to as a first curved arcuate side wall section. The slightly curved arcuate side wall section of the lower rudder blade section is herein referred to as the second curved arcuate side wall section. The highly curved arcuate side wall section of the upper rudder blade section is herein referred to as the third curved arcuate side wall section. The highly curved arcuate side wall section of the lower rudder blade section is herein referred to as the fourth curved arcuate side wall section.

It has surprisingly been found that as a result of the configuration of the twisted rudder blade as a balanced rudder according to the invention, having a small profile thickness and the mounting of the rudder post in the area of the greatest profile thickness in the upper rudder blade section of the rudder blade, the lower rudder blade section acquires a narrow profile. Despite the high speeds of the propeller current impinging upon the rudder blade, a balancing of the rudder blade is possible without additional expenditure of force even when this has the largest dimensions, which is only attainable as a result of the functional cooperation of the twisted rudder blade with the rudder blade mounting but which cannot be achieved with other rudder blade configurations and rudder post mountings.

The invention provides a rudder arrangement, i.e. a system comprising two components, i.e. a twisted rudder blade and a specially mounted rudder post cooperating functionally therewith. This rudder arrangement is the technical solution which has surprisingly been found for building large and extremely large balanced rudder blades. The rudder pipe drawn deeply into the upper rudder blade section of the rudder blade guides the rudder forces directly into the ship's hull by means of a collar bearing integrated in the lower region of the upper rudder blade section. The forces are introduced as a cantilever, i.e. as pure bending stressing without torsional moments. As a result, the rudder pipe cross-section can be designed as relatively thin-walled. This thin-walled property is very important since the lower part of the rudder pipe is accommodated in the rudder blade, i.e., in the upper rudder blade section and thus has a direct influence on the profile thickness of the rudder blade. Only a slender rudder profile, i.e. a small profile thickness makes it possible to build energy-efficient rudder blades since the thicker the rudder profile, the more resistance it produces in the accelerated flow of the propeller water.

A further advantage of the rudder arrangement of the combination of the twisted rudder blade with the mounting of the rudder post is the use of higher-quality materials. High-strength forged steel can be used only as a result of the mounting of the rudder post in the upper rudder blade section according to the invention so that a substantial reduction in weight is possible and is also achieved, i.e. up to 50% of the conventional rudder having the same performance.

A further substantial advantage of the rudder arrangement with the combination of rudder post mounting is that as a result of this type of integrated mounting in the rudder blade, i.e. in the upper rudder blade section, the design of the balanced rudder or spade rudder is made possible for the first time and this is almost unlimited size. Conventional rudders are semibalanced rudders with a rudder horn or rudder support. Such intricate mechanical structures can barely be twisted at the leading edge since the fixed rudder horn and the rudder blade rotating therearound are not so freely formable. The rudder-blade internal forces and moments occurring in these semibalanced rudders are non-uniformly greater than in balanced rudders having the mounting of the rudder post according to the invention. A significant twisting of the leading edge of the rudder blade facing the propeller would mean design measures, i.e. correspondingly thicker profiles, of considerable expense.

Another advantage is that due to the mounting of the rudder post, balanced rudders as a structural form are possible for the first time which means that gaps no longer exist between the previously required rudder horns and their rudder blades. As a result, transverse flow through these gaps is avoided and the severe cavitation erosion pertaining thereto is also avoided.

In addition, in another exemplary embodiment of the rudder arrangement according to the invention, the rudder pipe preferably consists of forged steel and is extended into the rudder blade, i.e. into the upper rudder blade section but only with one lower collar bearing. The rudder post, likewise with a forged piece as a hub is connected close to the hydrodynamic centre to the rudder with the result that only a small loading due to bending moments is achieved. Superposed vibrations can be eliminated by this configuration.

As a result of the slender rudder profile and therefore due to the small profile thickness of the rudder blade, it is possible, without particular stressing of the bearing for the rudder post, to balance out the rudder blade with respect to the high pressure of the propeller current impinging on the lower rudder blade section at very high speed.

In order to eliminate the cavitation at the rudder blade, the profile according to the invention is divided into an upper and a lower half, whose nose strips or leading edges are twisted at certain angles. The propeller wake flow and the angle of said flow to the mid ship line prescribes by how many degrees the profile leading edge is twisted. As a result of this new profile variant, the propeller vortex flow flows better along the rudder blade and no pressure peaks which promote cavitation are formed on the profile surface of the rudder blade. The improved flow around the rudder leads to appreciable savings of fuel and to improved maneuverability.

The invention thus provides a rudder blade arrangement such that a fastening plate is arranged between the upper rudder blade section and the lower rudder blade section and is firmly connected to the rudder blade sections. The fastening plate has symmetrical cross-sectional surface sections on both sides of the longitudinal central line LML and a surface profile and dimensions which enclose the base plate of the upper rudder blade section and the cover plate of the lower rudder blade section with their profiles and dimensions.

A further embodiment of the invention provides that the nose strip of the upper rudder blade section and the nose strip of the lower rudder blade section are laterally offset to port BB and starboard SB with respect to the longitudinal central line LML in such a manner that the offset central line M2 drawn through the laterally offset nose strip sections is running at an angle $\alpha$ of at least 3° to 10° but also higher, preferably 8° to the longitudinal central line LML of the cross-sectional area of a rib.

Furthermore, an embodiment according to the invention is provided where a slightly curved arcuate side wall sections of the upper and lower rudder blade sections located on the port side BB and the starboard side SB have a shorter length L4 compared with the length L5 of the highly curved arcuate side wall sections of the upper and lower rudder blade sections located on the starboard side SB and on the port side BB.

The invention furthermore provides that the arc length BL1 of the highly curved arcuate side wall sections of the upper and lower rudder blade sections is far greater than the arc length (BL) of the slighty curved arcuate side wall sections of the upper and lower rudder blade sections so that the transition zones OB1 of the highly curved arcuate side wall sections of the upper and lower rudder blade sections to the side wall sections running rectilinearly to the end strip and the transition zones OB of the flatly curved arcuate side wall sections of the upper and lower rudder blade sections to the side wall sections running rectilinearly to the end strip are offset in the direction of the end strip.

The various features of novelty which characterize the invention are pointed out with particularity in the claims forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

The rudder arrangement 200 according to the invention consists of two functionally cooperating components which achieve the object of the invention, i.e. a balanced rudder having a twisted rudder blade 100 and a rudder post 140 mounted in its upper region (FIGS. 1, 2, 3, 7 and 14).

Figure 1:
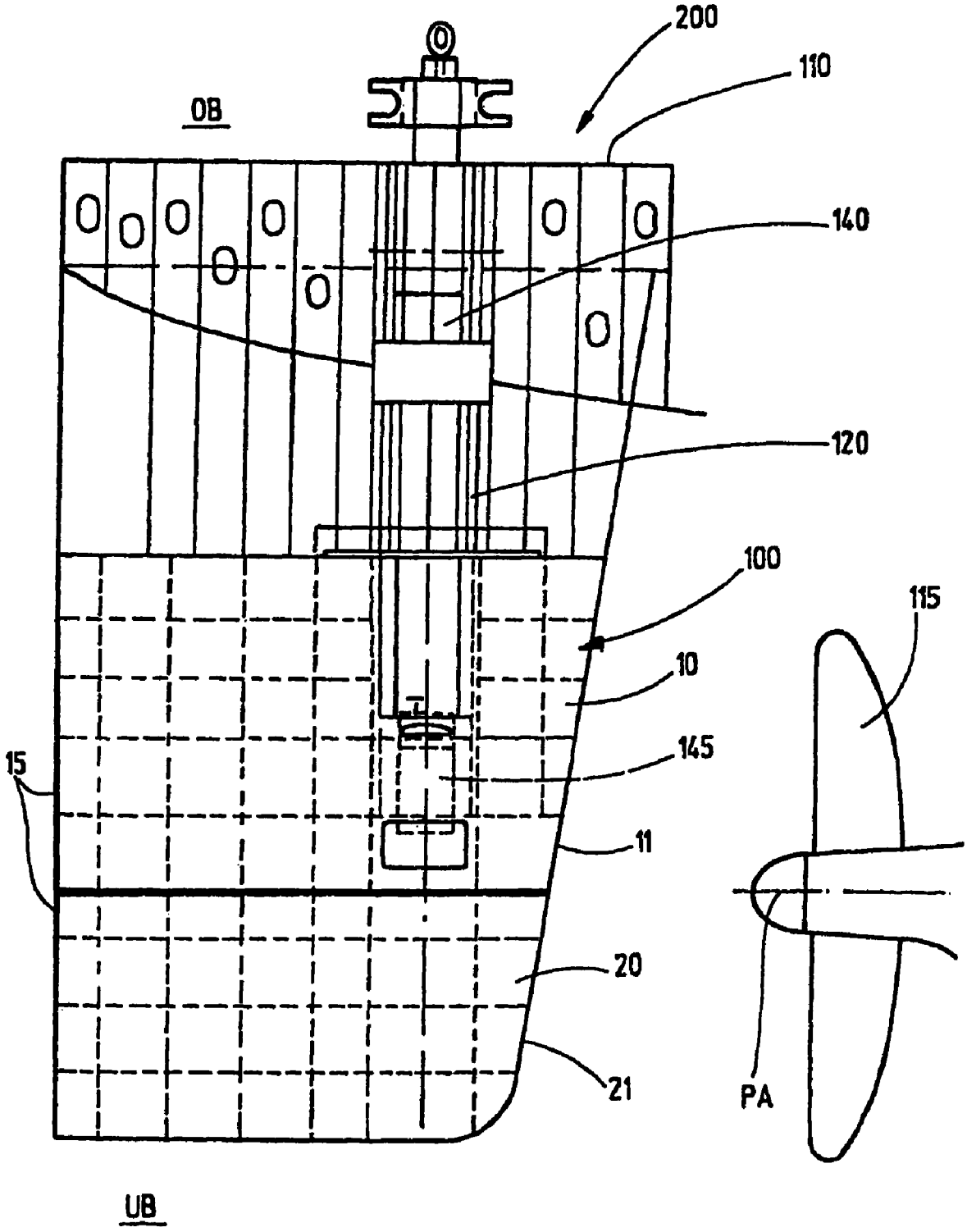
FIG. 1 is a side view of the rudder arrangement comprising a twisted balanced rudder blade having an upper and a lower rudder blade section and comprising a rudder post mounted in the upper rudder blade section.

In the rudder arrangement 200 shown in FIG. 1, 110 designates a ships' hull, 120 designates a rudder pipe for receiving the rudder post 140, and 100 designates the rudder blade. A propeller 115 is assigned to the rudder blade 100. The propeller axis is designated by PA. The rudder blade 100 is disposed behind the propeller 115 and in-line with the propeller axis PA.

The rudder blade 100, according to FIGS. 1, 2, 3 and 7, consists of two superposed rudder blade sections 10 & 20 whose nose strips 11 & 21 facing the propeller 115 are offset in such a manner that the nose strip 11 of the upper rudder blade section 10 is laterally offset to port BB from the longitudinal central line LML of the rudder blade 100. The nose strip 21 of the lower rudder blade section 20 is offset to starboard SB laterally from the longitudinal central line LML of the rudder blade 100 (FIGS. 4, 4A, 4B, 4C, 4D, 4E and 13). The lateral offset of the nose strips 11 & 21 can be achieved such that the nose strip 11 of the upper rudder blade section 10 is offset to starboard SB and the nose strip 21 of the lower rudder blade section 20 is offset to port BB. The two side wall surfaces 12 & 13 of the upper rudder blade section 10 and the side wall surfaces 21 & 23 of the lower rudder blade section 20 run from the nose strips 11 & 21 in an arcuate manner in the direction of an end strip 15 facing away from the propeller 115 with interposed and rectilinearly running side wall sections 16 & 17 and 26 & 27 which converge into the end strip 15. The two rudder blade sections 10 & 20 have a common end strip 15 whereas each rudder blade section 10 & 20 has a nose strip 11 and 21 whereby the twisting is achieved as result of their lateral displacements.

The rudder arrangement 200 preferably comprises a balanced rudder, although differently configured rudders can also be used if these are suitable for fitting with twisted rudder blades and the advantages of the rudder blade configuration according to the invention are achieved. The two superposed rudder blade sections 10 & 20 may have the same height, but preferably have different heights. The lower rudder blade section 20 preferably has a small height compared with the height of the upper rudder blade section, the height of the upper rudder blade section 10 corresponding to at least 1½ times the height of the lower rudder blade section 20. The nose strips 11 & 21 of the two rudder blade sections 10 & 20 are configured as semicircular-arc-shaped.

Figure 2:
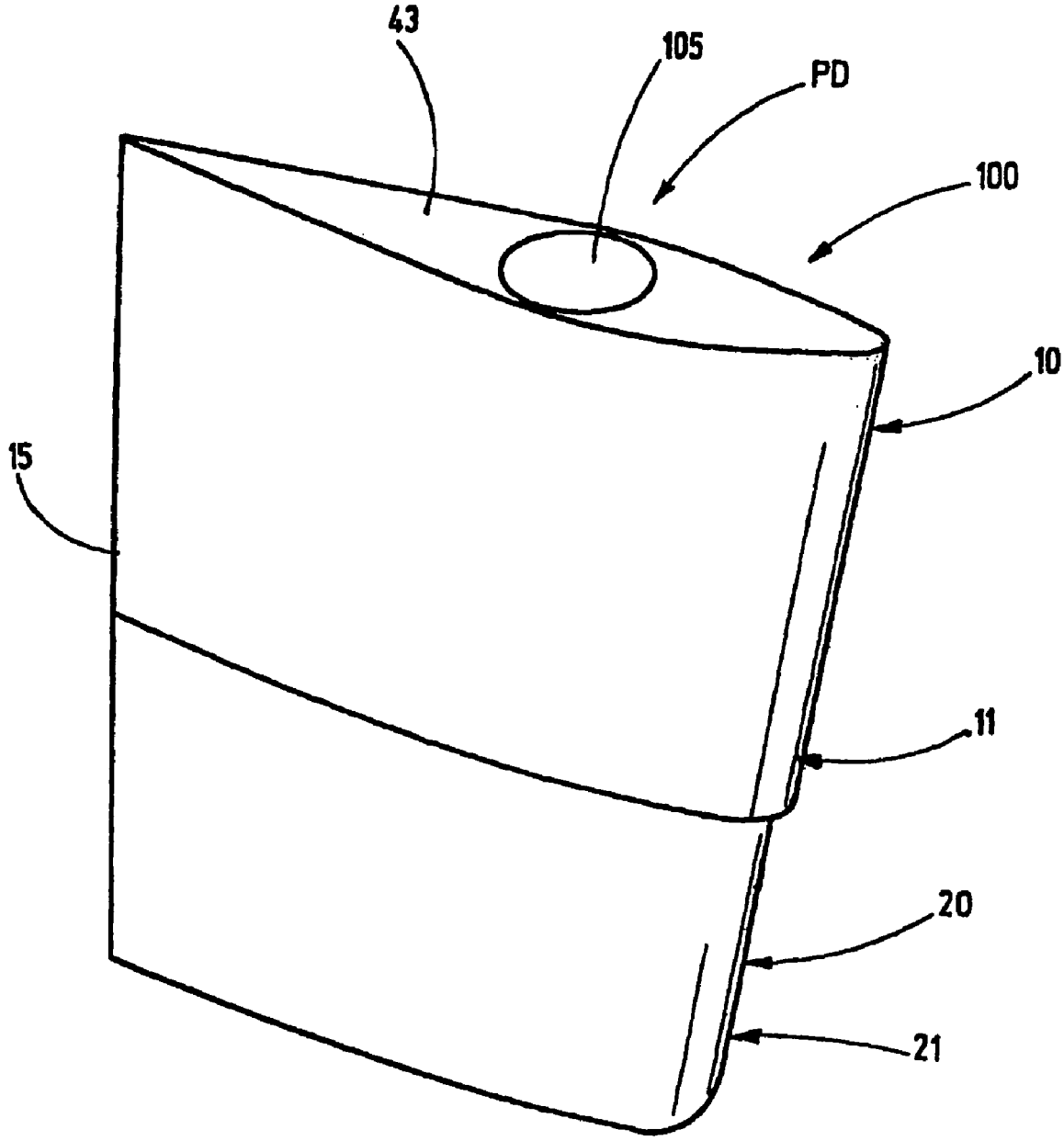
FIG. 2 is a diagrammatic view of the twisted rudder blade of the rudder arrangement of FIG. 1.
Figure 3:
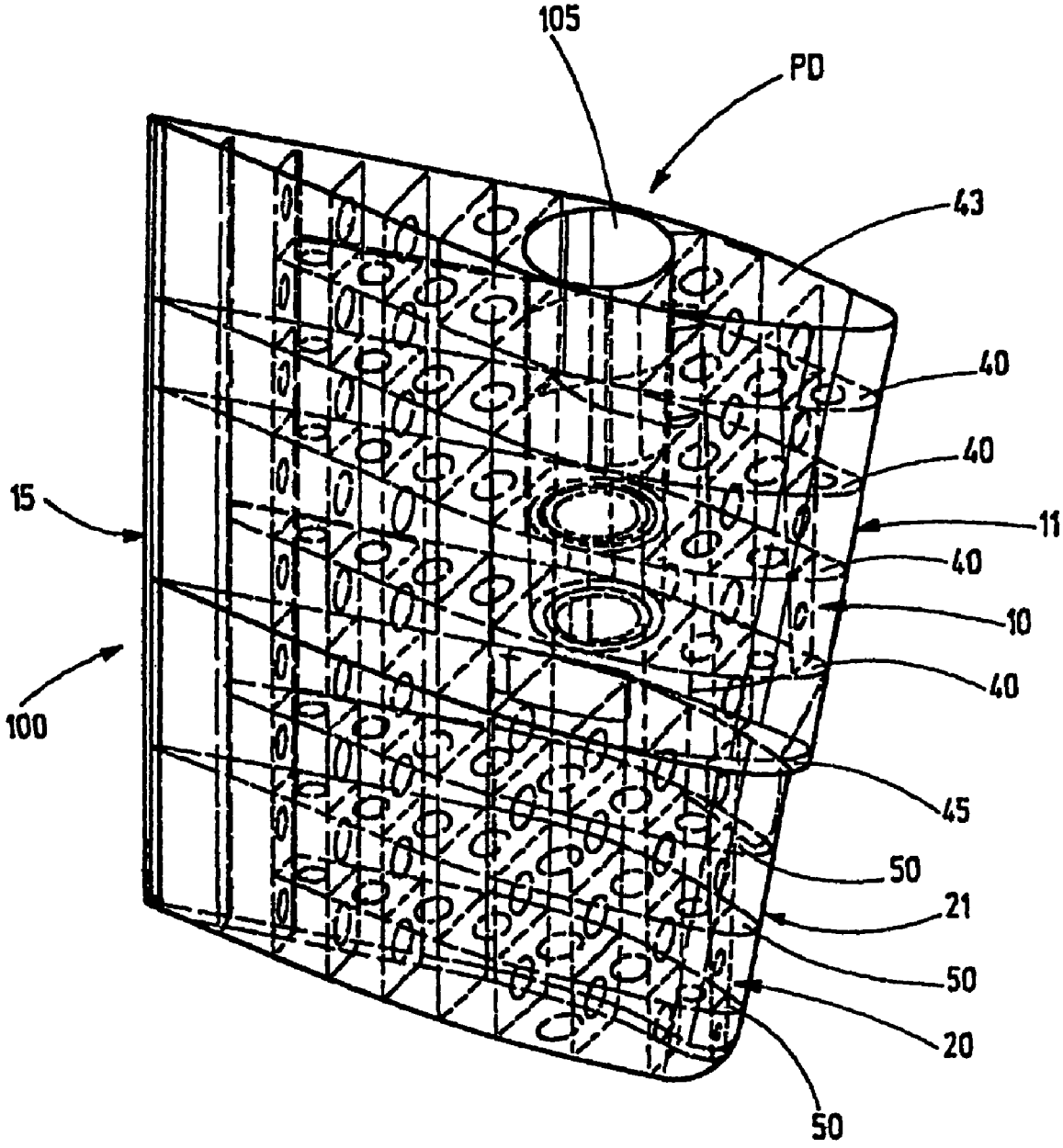
FIG. 3 shows a schematic skeletal diagram of the twisted rudder blade of FIG. 2 with the outer skin removed and a number of plate-shaped frames in the two rudder blade sections.
Figure 4:
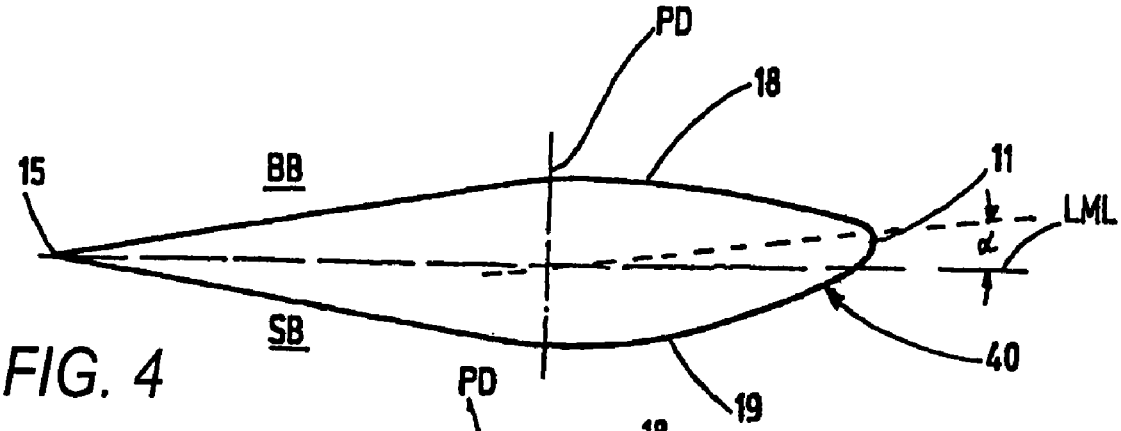
FIGS. 4, 4A, 4B, 4C show four plate-shaped frames of the upper rudder blade section of the rudder blade according to FIG. 3.
Figure 4A:
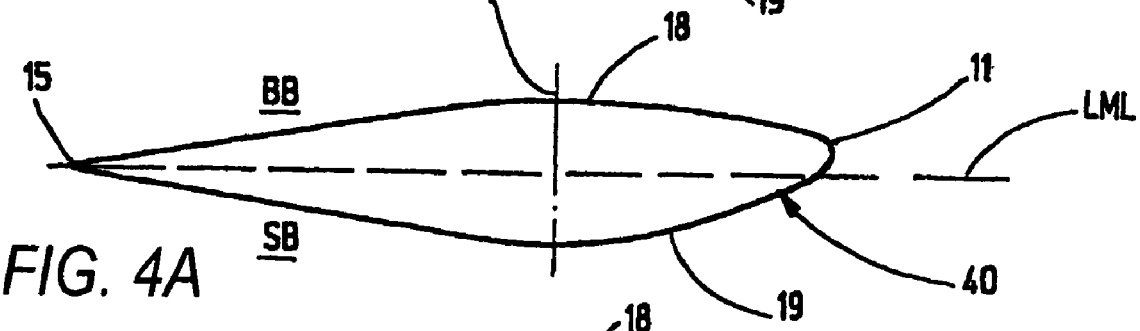
Figure 4B:
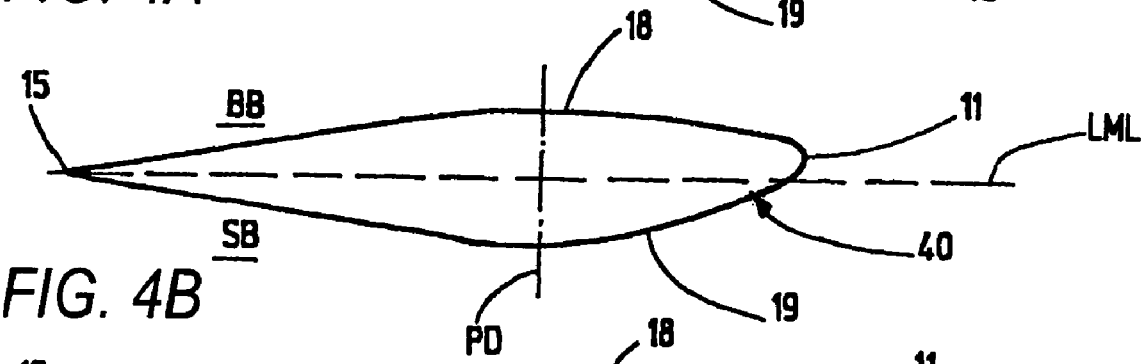
Figure 4C:
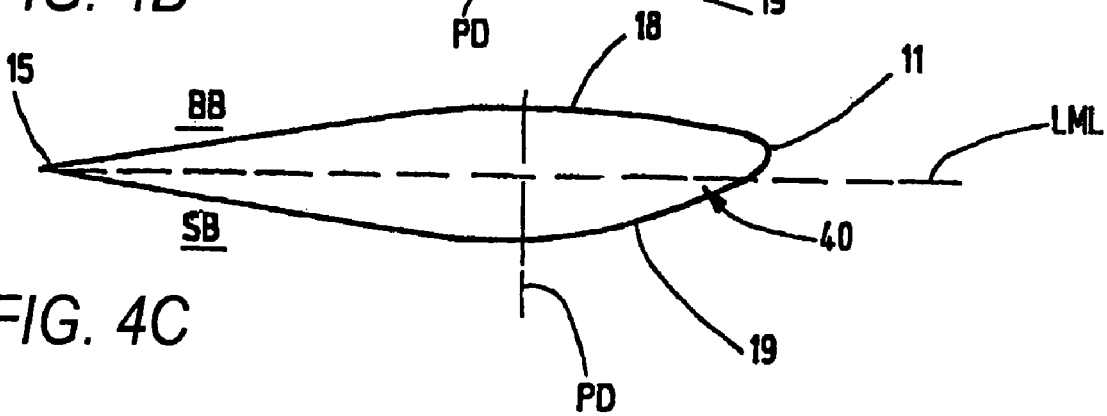
Figure 4D:
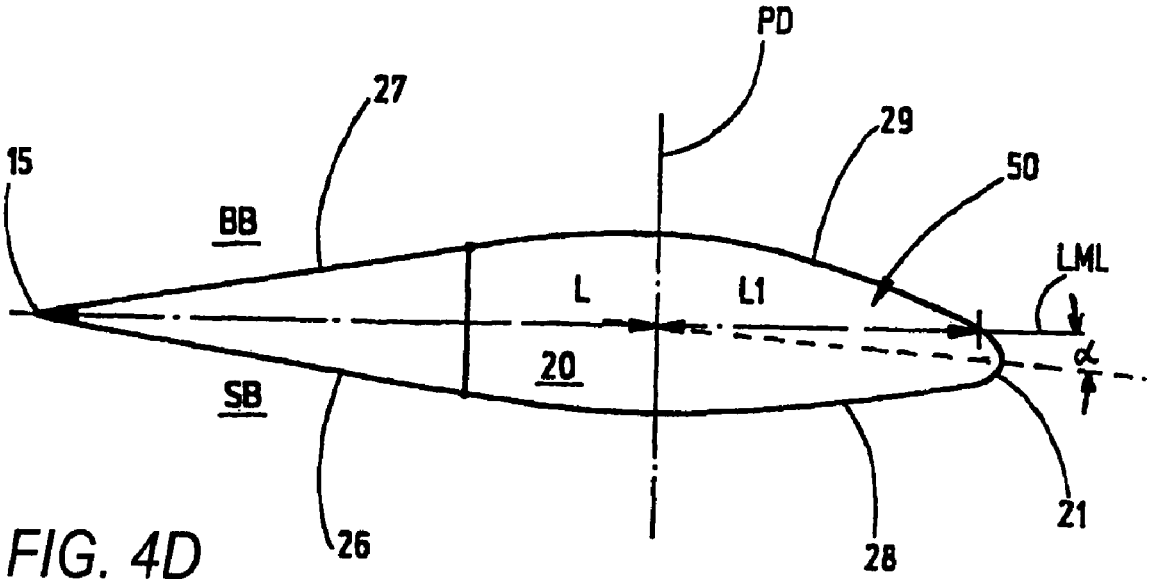
FIG. 4D is an enlarged view of a plate-shaped frame of the lower rudder blade section of the rudder blade according to FIG. 3.
Figure 4E:
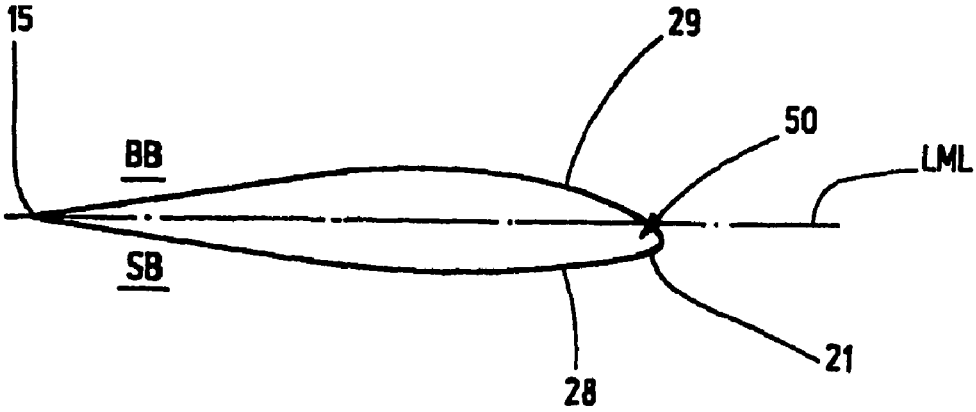
FIG. 4E shows a plate-shaped frame of the lower rudder blade Section of the rudder blade according to FIG. 3.

The rudder blade 100 has conically downwardly running nose strips 11 & 21, whereas the end strip 15 is rectilinear and runs parallel to the rudder post 140 (FIGS. 1, 2 and 3). The conical profile of the nose strips 11 & 21 of the two rudder blade sections 10 & 20 are such that the size of the cross-sectional surfaces 30 of the two rudder blade sections 10 & 20, for the same profile configuration of the upper rudder blade section 10 and for the same profile configuration of the lower rudder blade section 20, decreases from the upper region OB to the lower region UB of the rudder blade 100. Due to the reduction of the cross-sectional surfaces 30, a downwardly extending slender profile having a small profile thickness, which is in particular determined by the profile of the side wall surfaces 12, 13 and 22, 23 of the two rudder blade sections 10, 20 is obtained. The small profile thickness of the rudder blade 100 is also an essential feature of the invention.

Figure 13:
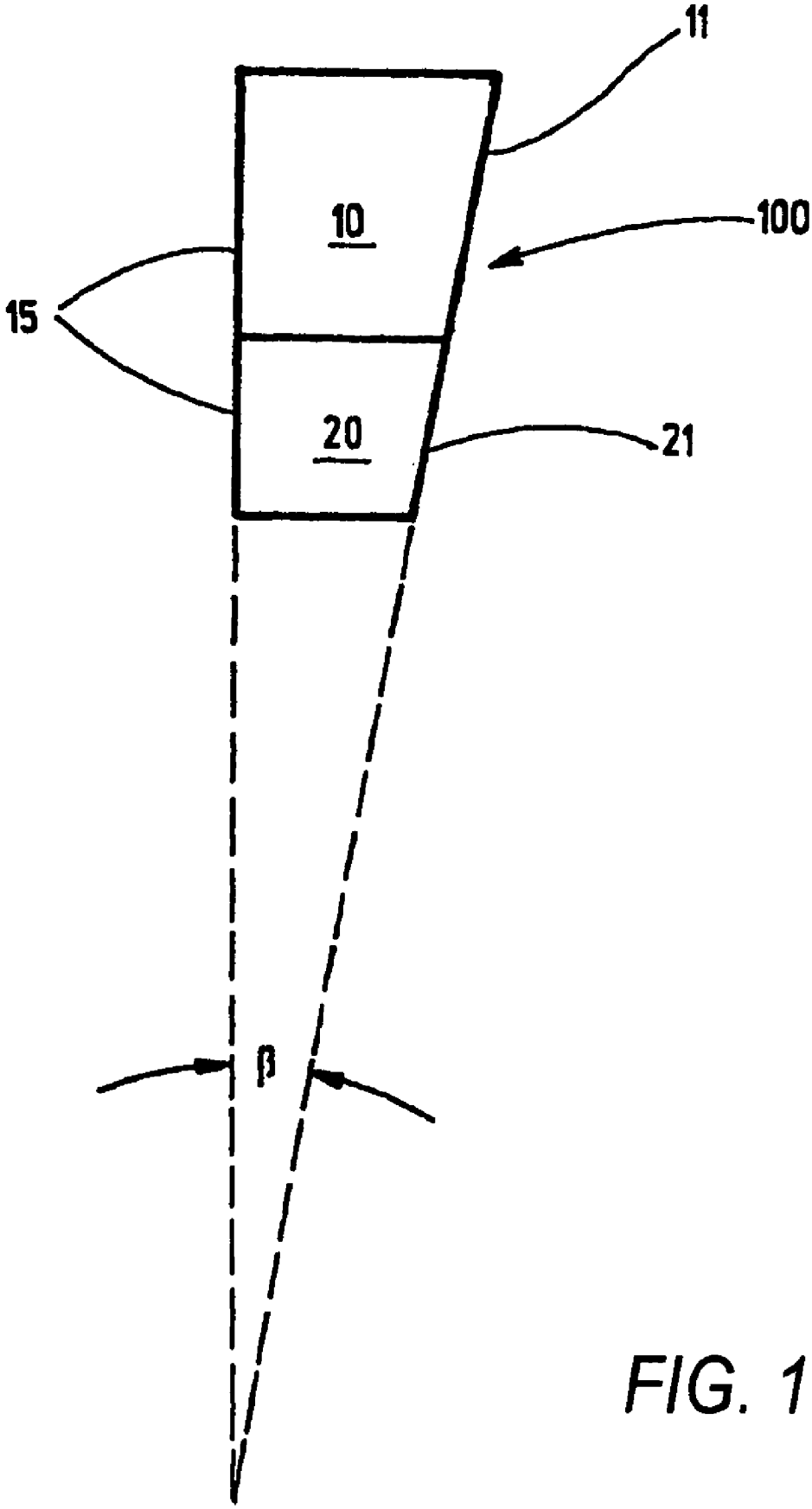
FIG. 13 is a side view of the rudder blade with obliquely running rudder blade edges on the propeller side.

As shown in FIG. 13, the edge or nose strip 11, 21 of the rudder blade 100 facing the propeller 115 runs obliquely to the edge or end strip 15 facing away from the propeller at an angle β of at least 5°, preferably 10°.

Figure 5:
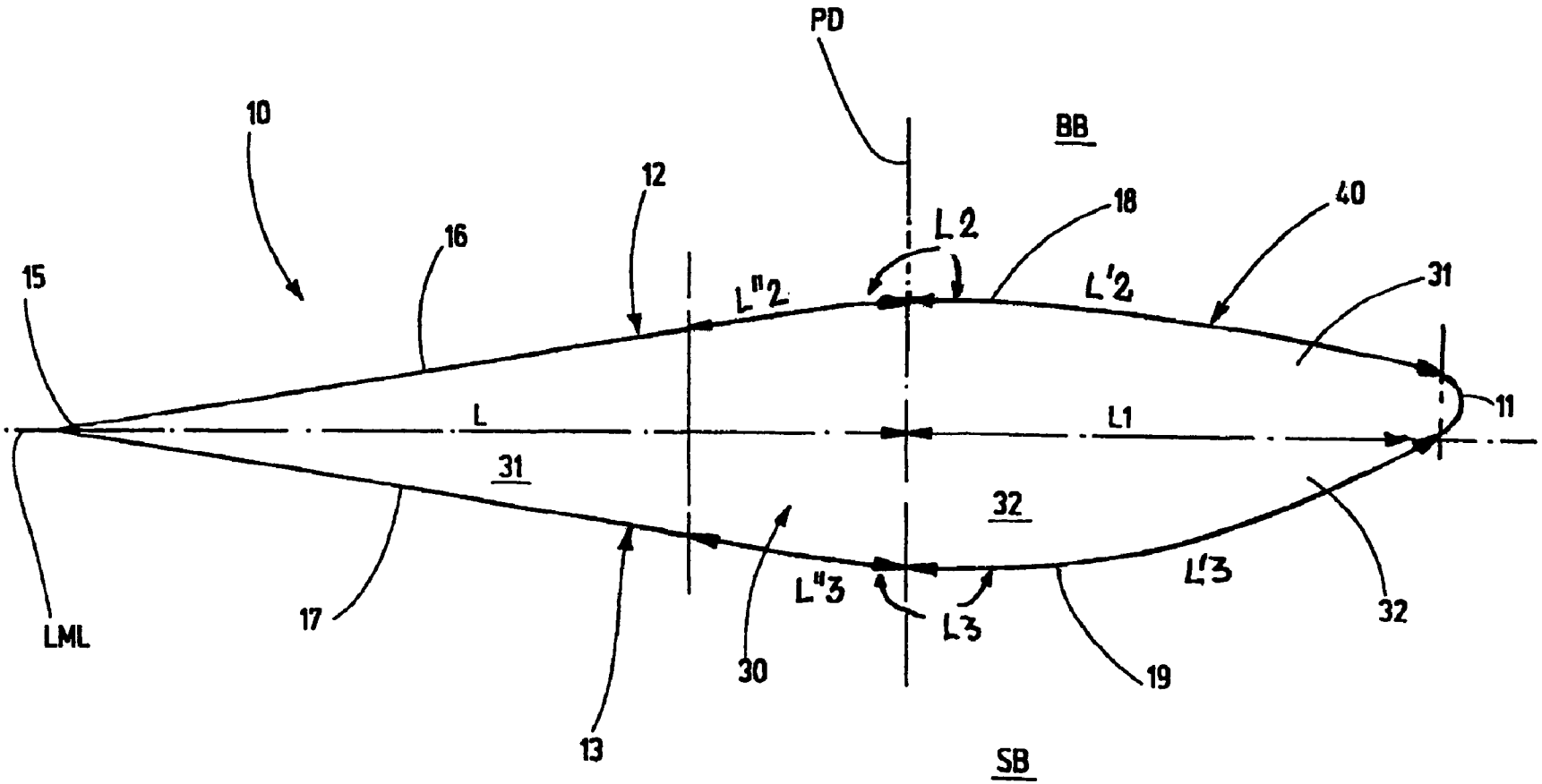
FIG. 5 shows an enlarged reproduction of the plate-shaped frame according to FIG. 4.

The lengths L and L1 of the cross-sectional surface sections 31 & 32 of both rudder blade sections 10 & 20 on either side of the largest profile thickness PD are different. The cross-sectional sections 31 of both the upper rudder blade section 10 and the lower rudder blade section 20 in the area between the end strip 15 and the largest profile thickness PD of the rudder blade 100 have a greater length L compared with the length L1. The length L1 of the cross-sectional surface sections 32 of the upper rudder blade section 10 and the lower rudder blade section 20 is between the largest profile thickness PD of the rudder blade 100 and the nose strips 11 & 21. In this case, the length ratio is preferably at least 1½ times, where the distance of length L is at least 1½ times the distance of length L1 (FIG. 5).

The configuration of the rudder blade is such that the upper rudder blade section 10 on the port side BB and the lower rudder blade section 20 on the starboard side SB each comprise side wall sections 18 & 28 running in a slightly arcuate manner and extending from the nose strips 11 & 21 in the direction of the end strip 15, having a length L2. Length L2 includes the length L'2 of the side wall section 18 defined from the nose strips 11 & 21 to as far as the greatest profile thickness PD. Length L2 also includes a length L"2 which corresponds to at least ⅓ of the length L'2, wherein the side wall section 18 running in a slightly arcuate manner is adjoined by the rectilinearly running side wall section 16 which ends in the end strip 15 (FIG. 5).

Furthermore, the upper rudder blade section 10 on the port side BB and the lower rudder blade section 20 on the starboard side SB each comprise a highly curved side wall section 19 & 29 running in an arcuate manner and extending from the nose strips 11 & 21 in the direction of the end strip 15 having a length L3. Length L3 includes the length L'3 of the side wall section 19 from the nose strips 11 & 21 to as far as the greatest profile thickness PD. Length L3 also includes a length L"3 which corresponds to at least ⅓ of the length L'3. The highly curved side wall section 19 & 29 running in an arcuate manner is adjoined by the rectilinearly running side wall section 17 & 27 which ends in the end strip (FIG. 5, 4D).

As a result of this configuration of the two rudder blade sections 10 & 20, the side wall sections on both sides have ascending profiles from the nose strips 11 & 21 and from the end strip 15 in the direction of the largest profile thickness PD.

The nose strip 11 of the upper rudder blade section 10 and the nose strip 21 of the lower rudder blade section 20 are laterally offset to port BB and starboard SB with respect to the longitudinal central line LML in such a manner that the central line M2 drawn through the laterally offset nose strip sections is running at an angle α of at least 3° to 10° but could also be higher. An angle α of 8° between the longitudinal central line LML of the cross-sectional area of a rib is preferred.

The rudder arrangement 200 further comprises a rudder post 140 (in particular made of forged steel or another suitable material) which cooperates functionally with the rudder blade 100 which is mounted in a rudder pipe 120 (in particular made of forged steel or another suitable material) by means of at least one bearing 150. The rudder post 140 is arranged in the area of the greatest profile thickness PD of the upper rudder blade section 10 (FIGS. 1, 2, 3 and 15) at the point of intersection of the line representing the greatest profile thickness PD and the longitudinal central line LML (FIG. 5). The rudder post 140 extends together with its fastening device 145 over the total height of the upper rudder blade section 10 of the rudder blade 100. For construction reasons the rudder pipe 120 with the rudder post 140 can also be arranged in the upper rudder blade section 10 between the greatest profile thickness PD and the nose strips 11 & 21.

Figure 14:
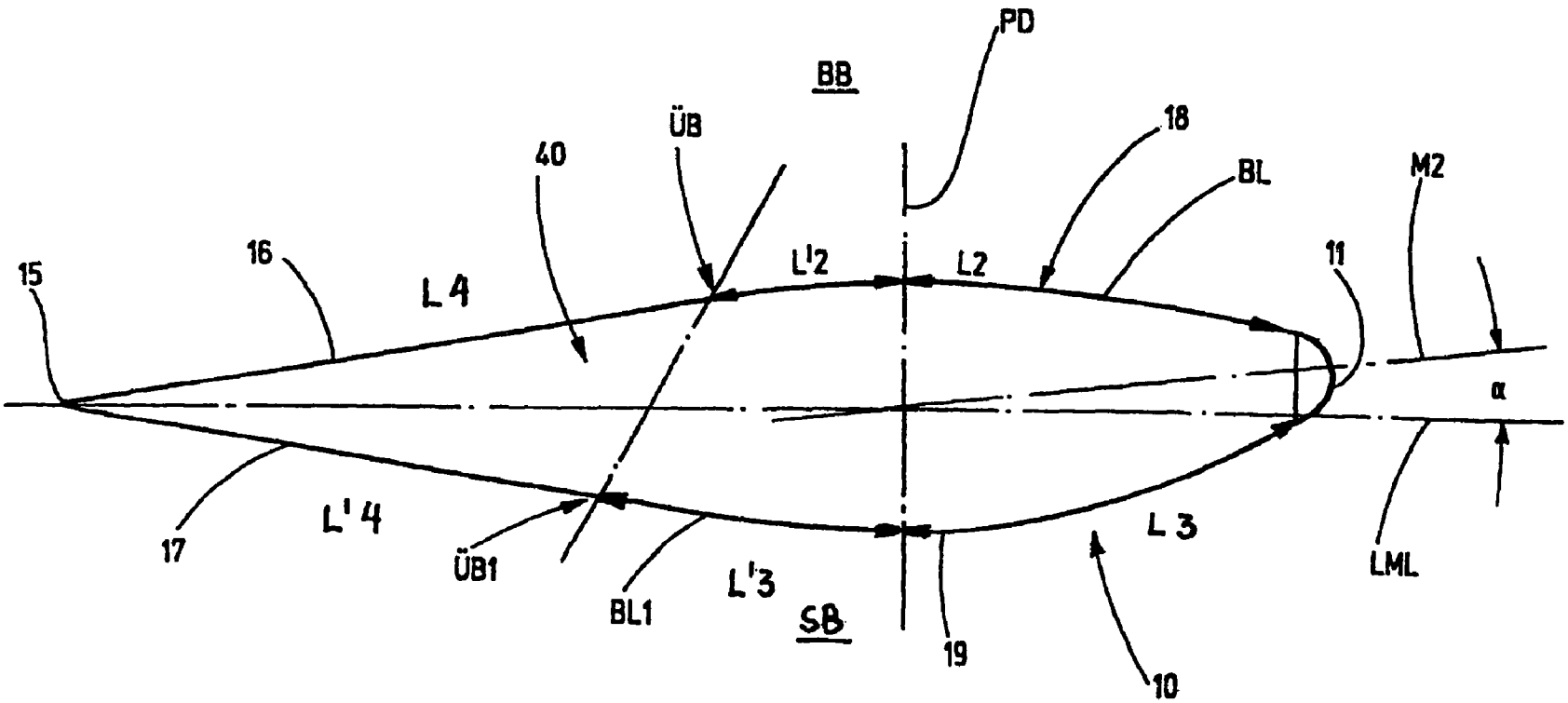
FIG. 14 is a view from above of the cross-sectional profile of a frame of the upper rudder blade of another embodiment.
Figure 15:
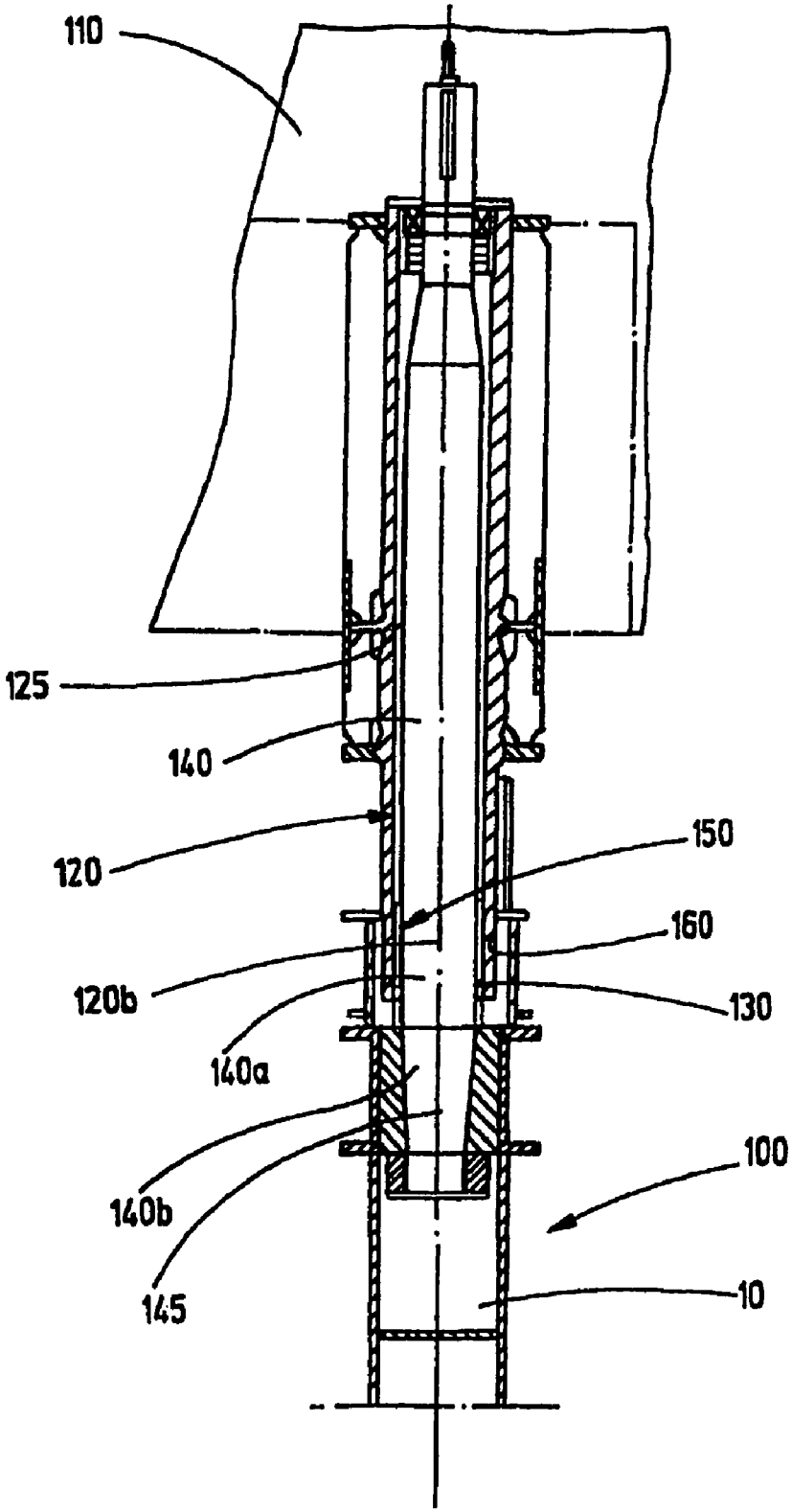
FIG. 15 is a perpendicular sectional view of the rudder post mounting with the rudder pipe for the rudder post arranged in the upper rudder blade section.

The rudder pipe 120 which is drawn deeply into the upper rudder blade section 10 as a cantilever is provided with an inner hole 125 for receiving the rudder post 140 (FIG. 14). The rudder pipe 120 is arranged by inserting the rudder pipe into gaps 105 in the frames 40 of the upper rudder blade section 10 according to the outside diameter of the rudder pipe (FIGS. 3, 8, 8A, 8B, 8C).

The rudder pipe 120 acts as a cantilever and is provided with a central inner longitudinal hole 125 for receiving the rudder post 140 for the rudder blade 100. In addition the rudder pipe 120, in as much as the rudder blade 100 connected to the rudder post end, is configured as extending only into the upper rudder blade section 10. In its inner hole 125 the rudder pipe 120 has the bearing 150 for mounting the rudder post 140. This bearing 150 is preferably arranged in the lower end region 120*b* of the rudder pipe 120. The end 140*b* of the rudder post 140 is guided out from the rudder pipe 120 from section 145. The free lower end of this lengthened section 145 of the rudder post 140 is firmly connected to the upper rudder blade section 10 at 170, wherein here however, a connection is provided which makes it possible to release the rudder blade 100 from the rudder post 140 if, for example, the propeller shaft needs to be exchanged. The connection of the rudder post 140 in the area with the twisted rudder blade 100 lies above the propeller axis PA so that for dismantling the propeller shaft the rudder blade 100 only needs to be removed from the rudder post 140. It is not necessary to withdraw the rudder post 140 from the rudder pipe 120 to exchange a propeller axle since both the free lower end 120*b* of the rudder pipe and also the free lower end of the rudder post 140 lie above the middle of the propeller shaft. In the embodiment shown in FIG. 15 only a single inner bearing 150 is provided for mounting the rudder post 140 in the rudder pipe 120, however another bearing for the rudder blade 100 on the outer wall of the rudder pipe 120 can be omitted.

The rudder blade 100 is provided with a retraction or recess indicated at 160 for receiving the free lower end 120*b* of the rudder pipe 120.

The cross-section of the rudder pipe 120 is designed as thin-walled having at least one collar bearing 130 on its inner wall side in the area of its free end for mounting the rudder post 140. Additional bearings for the rudder post can also be provided at other positions of the rudder pipe 120. In its end region 140*b* the rudder post 140 is guided out of the rudder pipe 120 with a section 140*a* and the end of this section 140*a* is connected to the upper rudder blade section 10 (FIG. 14).

Figure 7:
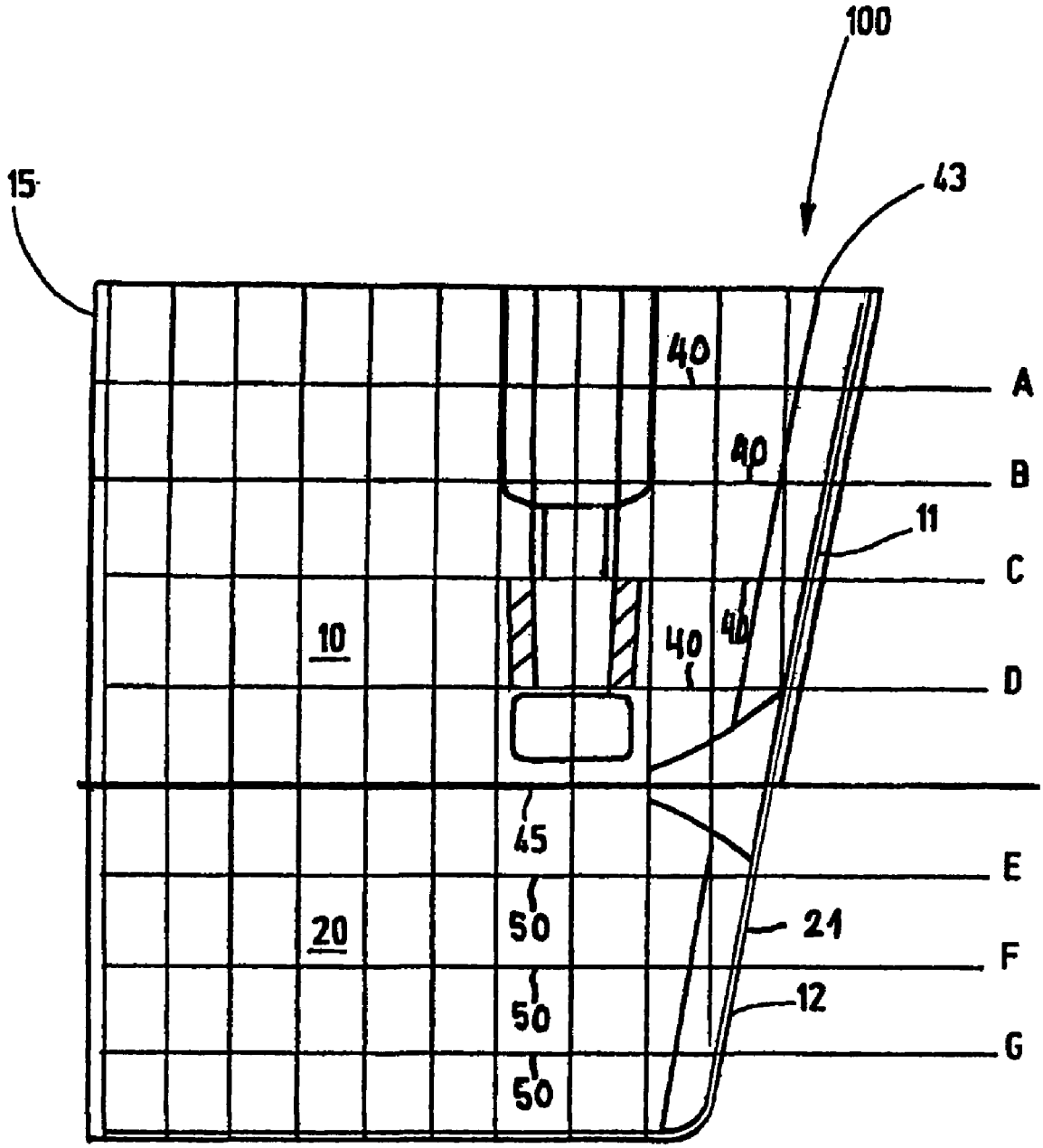
FIG. 7 shows a skeletal diagram of another embodiment of the twisted balanced rudder blade comprising a plurality of plate-shaped frames arranged in the upper rudder blade section and in the lower rudder blade section.
Figure 8:
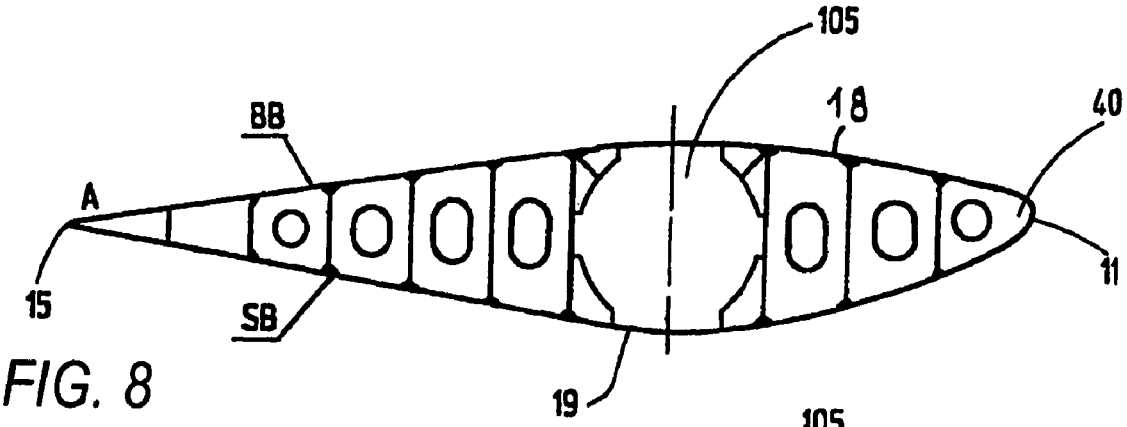
FIGS. 8, 8A, 8B, 8C are enlarged views from above of four plate-shaped frames of the upper rudder blade section of the rudder blade according to FIG. 7 with gaps for receiving the rudder pipe for the rudder post.
Figure 8A:
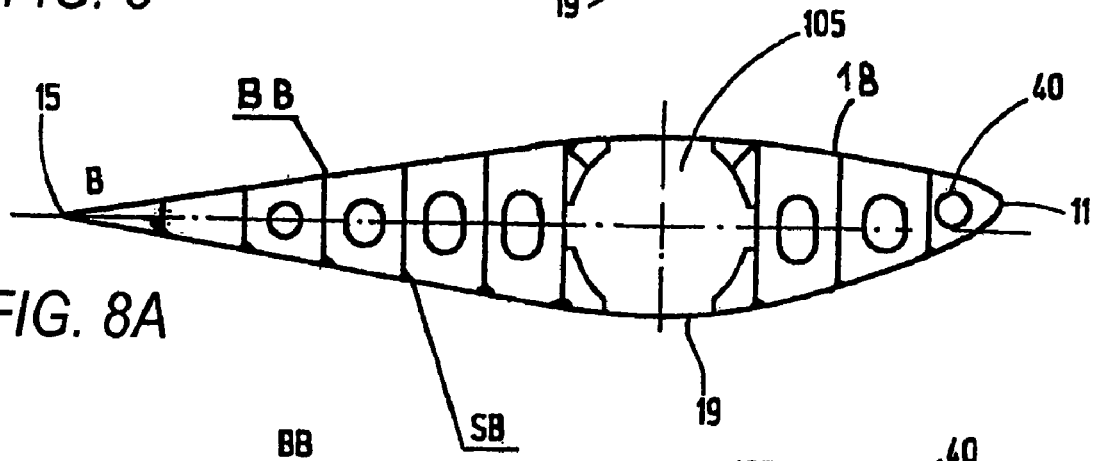
Figure 8B:
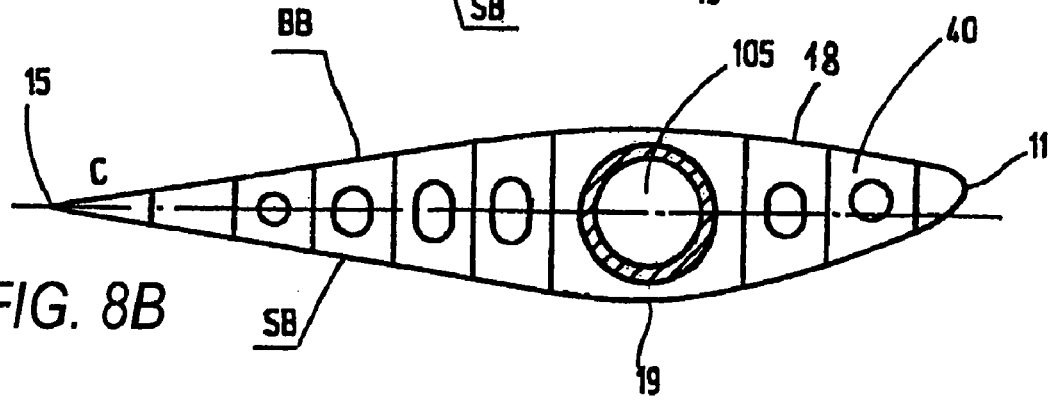
Figure 8C:
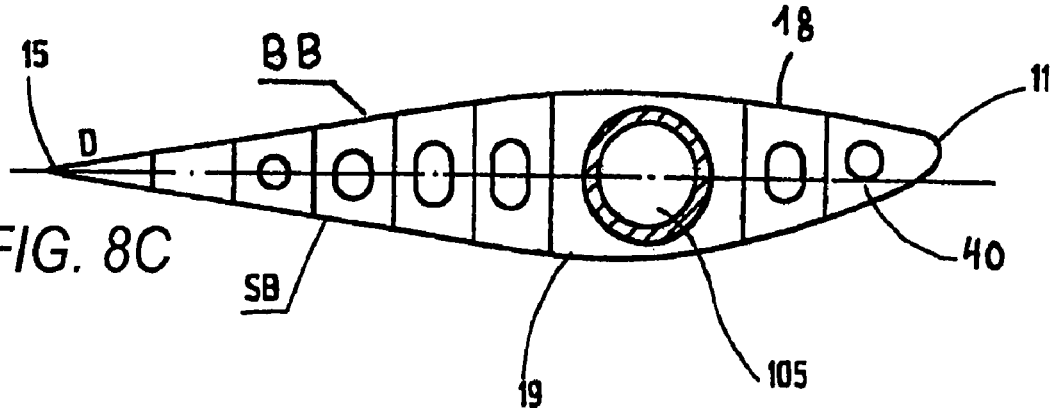
Figure 8D:
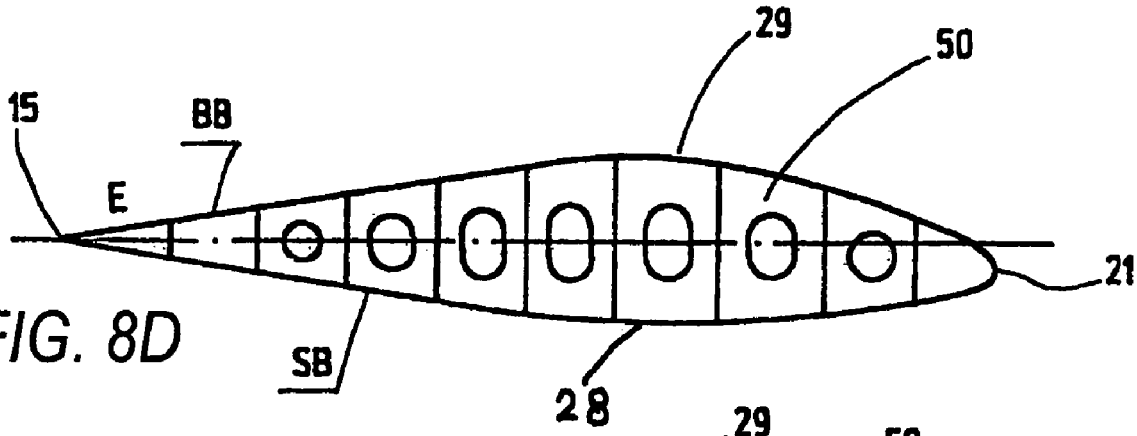
FIGS. 8D, 8E, 8F show enlarged views from above of three plate-shaped frames of the lower rudder blade section of the rudder blade according to FIG. 7.
Figure 8E:
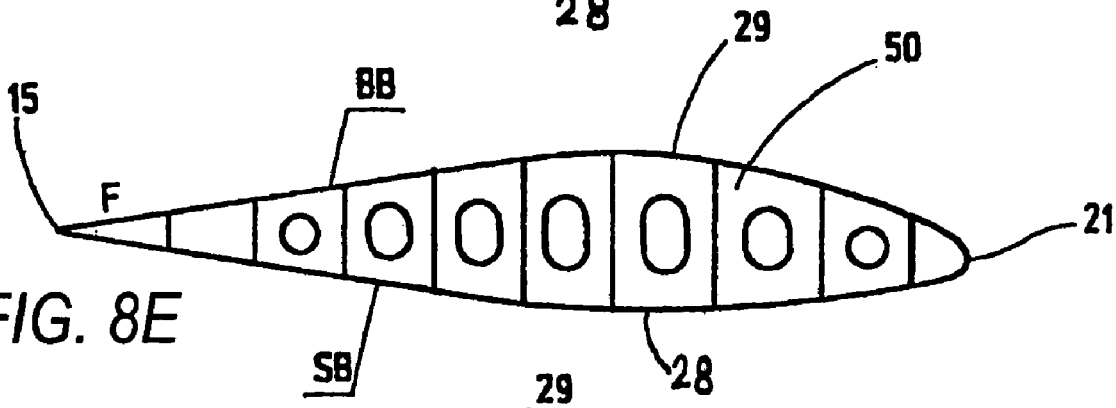
Figure 8F:
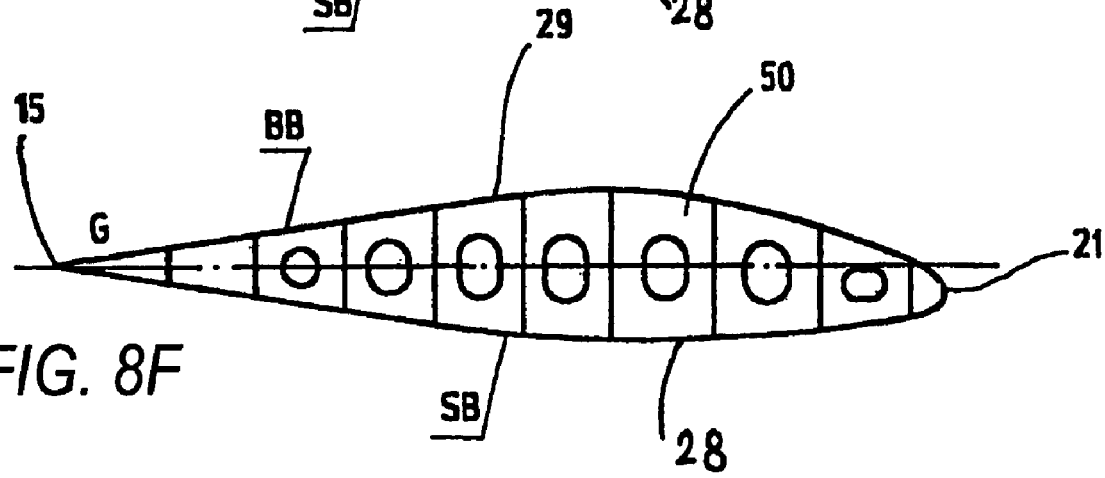

According to FIGS. 3 and 7, the upper rudder blade section 10 and the lower rudder blade section 20 consist of a rudder plating forming the side walls and horizontal web plates or frames 40 & 50 and vertical web plates or frames which form the inner stiffening of the two rudder blades. The web plates are provided with lightening and limber holes.

As shown in FIGS. 3, 4, 4A, 4B, 4C and 8, 8A, 8B, 8C, all the frames 40 of the upper rudder blade section 10 of the rudder blade 100 have the same shape, the same side wall guidance and matching nose strip 11 and end strips 15, where the length of the frames are decreasing from the respectively uppermost frame to the lowermost frame and thus the size of the cross-sectional surfaces of the frames are decreasing from top to bottom, so that the nose strips 11 run obliquely towards the base of the rudder blade 100 (FIG. 1).

All the frames 50 of the lower rudder blade section 20 have the same shape, the same side wall guidance and matching nose strip 21 and end strips 15, where the length of the frames 50 are decreasing from the respectively uppermost frame to the lowermost frame and thus the size of the cross-sectional surfaces of the frames are decreasing from top to bottom, so that the nose strips 11 run obliquely towards the base of the rudder blade 20.

As a result of this configuration, the nose strips 11 & 21 of the upper rudder blade section 10 and the lower rudder blade section 20 run obliquely downwards, whereas the end strips 15 run rectilinearly and parallel to the longitudinal axis of the rudder post 140, as shown in FIG. 1.

Figure 10:
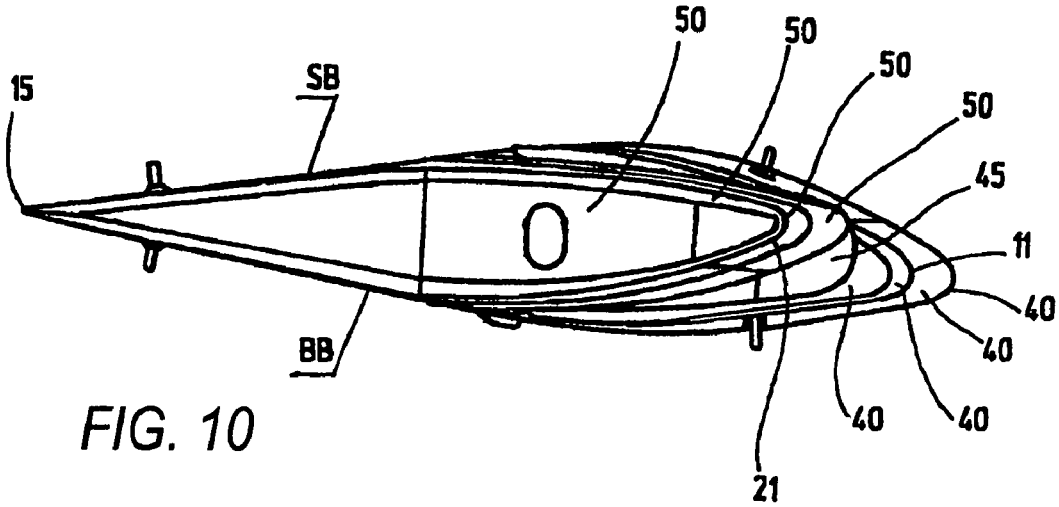
FIG. 10 is an enlarged view from below of the twisted rudder blade of the rudder arrangement according to FIG. 7.
Figure 11:
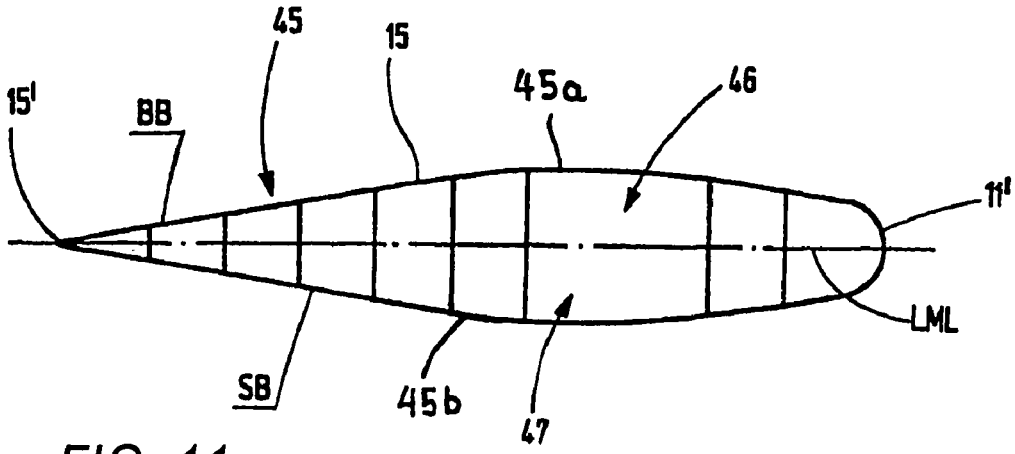
FIG. 11 is an enlarged view from above of a fastening plate arranged between the upper rudder blade section and the lower rudder blade section of the rudder arrangement according to FIG. 7 having a profile and having dimensions which include the profiles and dimensions of the base plate of the upper rudder blade section and the cover plate of the lower rudder blade section.
Figure 12:
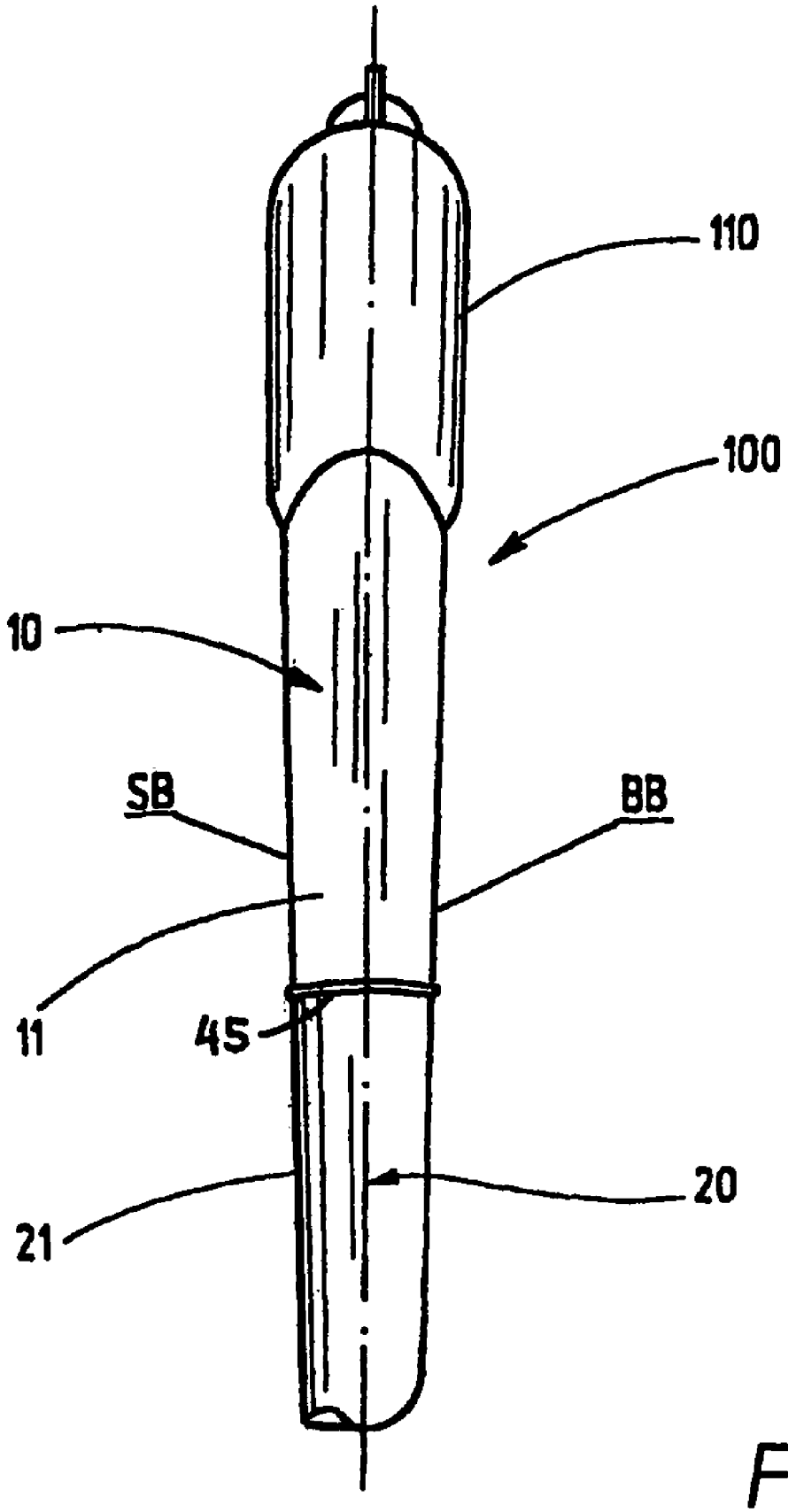
FIG. 12 is a front view of the twisted rudder blade.

The two rudder blade sections 10 & 20 can be connected directly to one another. In FIGS. 7 and 11, the two rudder blade sections 10 & 20 are connected to one another by means of a fastening plate 45. This fastening plate 45 has symmetrical cross-sectional surface sections 46 & 47 on both sides of the longitudinal central line LML and a surface profile and dimensions which enclose the base plate 42 of the upper rudder blade section 10 and the cover plate 41 of the lower rudder blade section 20. When the upper rudder blade profile 10 is placed on top of the fastening plate 45 and the lower rudder blade section 20 is placed on the fastening plate 45 from below, it projects laterally a very small edge region from the rudder blade sections 10 & 20 placed one upon the other (FIGS. 10 and 11). The fastening plate 45 has a semicircular edge rounding 11' lying on the central longitudinal line LML, facing the propeller and an edge 15' facing away from the propeller, which goes over into the end strips 15 of the two rudder blade sections 10 & 20. The side wall surfaces 45*a* & 45*b* of the fastening plate 45 have matching arc profiles.

As shown in FIGS. 3 and 10, the lower rudder blade section 20 adjoins the fastening plate 45 in the lower region, its frames 50 having a cross-sectional surface configuration and shape which corresponds to that of the frames 40 but with the frame 40 turned through 90° about its central longitudinal line LML (FIGS. 4D, 4E, 8D, 8E, 8F).

According to FIGS. 7, 8, 8A, 8B and 8C, the frames 40 of the sections A, B, C and D are the same in terms of profile but the cross-sectional surface of the individual frames 40 decreases from top to bottom so that the nose strip 11 runs obliquely. Section C is adjoined by section D with the fastening plate 45. The frames 50 of sections E, F and G of the lower rudder blade section 20 have the same profiles as the profiles of the frames 40 but the side walls with the highly curved arcuate side wall sections 29 of the frames 50 lies on the port side BB (FIGS. 8D, 8E and 8F) whereas in the exemplary embodiment of FIG. 7, the side walls of the frames 40 with the highly curved arcuate side wall sections 19 lie on the starboard side SB (FIGS. 8, 8A, 8B and 8C). The cross-sectional surfaces of the frames 50 of the lower rudder blade section 20 decrease from top to bottom in relation to their length so that the nose strip 21 of the lower rudder blade section 20 also runs obliquely (FIG. 7).

Figure 9:
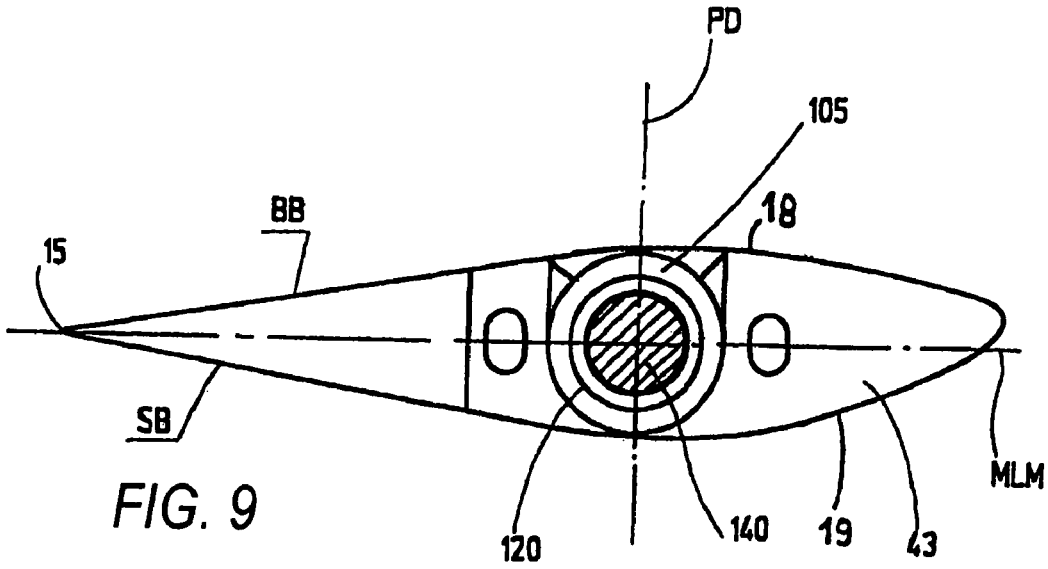
FIG. 9 is an enlarged view from above of the cover plate of the upper rudder blade section of the rudder blade according to FIG. 7 with the gap for receiving the rudder pipe for the rudder post.

FIG. 9 shows the upper cover plate 43 of the upper rudder blade section 10 which is provided with the gap 105 for introducing the rudder pipe 120. FIG. 10 shows a view from below of the rudder blade 100 with its two rudder blade sections 10 & 20 and the frames 40 and 50.

The diameter of the gap 105 or hole in the upper rudder blade section 10 for receiving the rudder pipe 120 for the rudder post 140 is somewhat smaller than the largest profile thickness PD of the rudder blade section 10. As a result of this configuration a very slender rudder blade profile is created.

Figure 6:
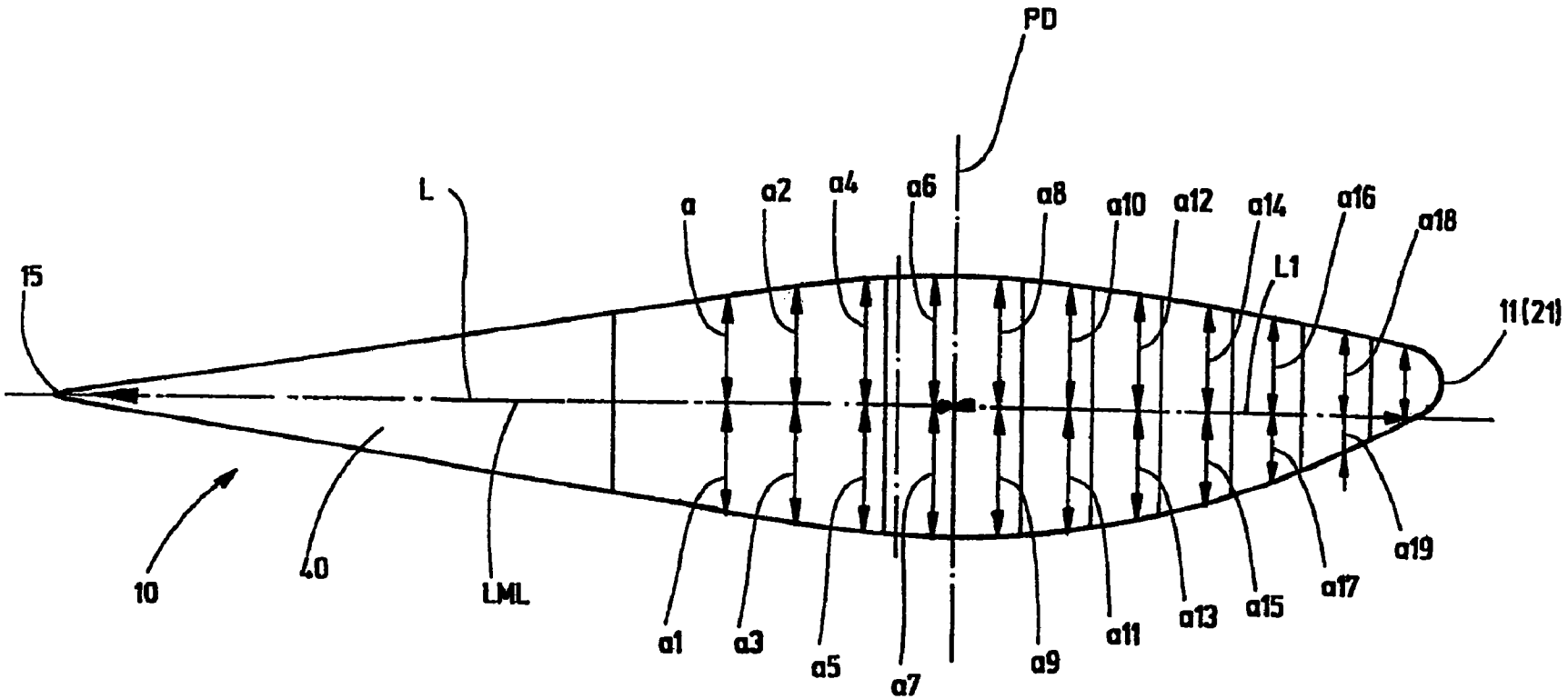
FIG. 6 shows an enlarged reproduction of the plate-shaped frame according to FIG. 4, with information on the distances of the lateral edge regions from the longitudinal central line of the frame.

The configuration and the cross-sectional profile of the rudder blade 100 with its two rudder blade sections 10 & 20 are such that the slightly curved arcuate side wall sections 18 & 28 of the upper and lower rudder blade sections 10 & 20 have a short length L2 & L'2 compared with the length L3 of the highly curved arcuate side wall sections 19 & 29 of the upper and lower rudder blade sections 10 & 20 (FIGS. 5 and 6). The distance (a) of the side wall section 18 of the upper rudder blade section 10 to the longitudinal central line LML and the distance (a1) of the side wall section 19 are the same. As far as the end strip 15 the distances (a), (a1) are always the same but they decrease in the direction of the end strip 15. The following distance relationships are obtained in the direction of the nose strip 11:

a2=a3 a4=a5 a6=a7

The greatest profile thickness PD then follows. Then the following distance relationships are then obtained in the direction of the nose strip a8>a9 a10>a11 a12>a13 a14>a15 a16>a17 a18>a19, wherein the ratio of the distances (a16) to (a17) is about 2:1. FIG. 6 clearly shows the ratio of the distances to one another, i.e. that the distances a9, a11, a13, a15, a17, a19 decrease substantially with respect to the distances a8, a10, a12, a14, a16, a18 in the direction of the nose strip 11. This cross-sectional profile with the distances shown extends through all the cross-sections of the upper rudder blade section 10 and through all the cross-sections of the lower rudder blade. Since all the cross-sectional surfaces of the upper rudder blade section 10 have the same shapes, it also applies to the cross-sectional surface of the lower rudder blade section 20 and specifically taking into account the fact that the cross-sectional surface or frames of the rudder blade 100 taper from top to bottom in relation to their lengths and in relation to their regions facing the nose strips (FIG. 10).

According to a further embodiment according to FIG. 14, the arc length BL1 of the highly curved arcuate side wall sections 19 & 29 of the upper and lower rudder blade section 10 & 20 is greater than the arc length BL of the slightly curved arcuate side wall sections 18 & 28 of the upper and lower rudder blade section 10 & 20. Accordingly, the transition zones ÜB1 of the highly curved arcuate side wall sections 19 & 29 of the upper and lower rudder blade sections 10 & 20 to the side wall sections 17 & 27 running rectilinearly to the end strip 15 and the transition zones ÜB of the slightly curved arcuate side wall sections 18 & 28 of the upper and lower rudder blade sections 10 & 20 to the side wall sections 16 & 26 running rectilinearly to the end strip 15 are offset in the direction of the end strip 15 in such a manner that the transition zone ÜB1 with respect to the transition zone ÜB is closer to the end strip. In this case, the lengths of the side wall sections 18 & 19 and 28 & 29 are as follows:

L3≧L2

L'2<L'3

L4>L'4

The legs of the rectilinear side wall sections 16, 17, 26, and 27 of the upper rudder blade section 10 and the lower rudder blade section 20 which converge to the end strip 15, preferably have the same lengths but an unequal length configuration is also possible.

The invention also embraces rudder arrangements in which the twisted rudder blade 100 is provided with a fin extending over the two rudder blade sections 10, 20.

The rudder arrangement according to the invention is characterized by the features specified in the claims, by the embodiments presented in the description and by the exemplary embodiments shown in the figures of the drawings.

While specific embodiments of the invention have been shown and described in detail to illustrate the inventive principles, it will be understood that the invention may be embodied otherwise without departing from such principles.

I claim:

1. A rudder arrangement for a ship comprising:

a propeller arranged on a drivable propeller axis for creating propulsion of the ship; and a rudder blade disposed behind the propeller and in-line with the drivable propeller axis, the rudder blade comprising an upper rudder blade section superposed and fixed relative to a lower rudder blade section about a longitudinal central line, a fastening plate is arranged between and connected to the upper rudder blade section and the lower rudder blade section, wherein the fastening plate has symmetrical cross-sectional surface sections on both sides of the longitudinal central line and a surface profile and dimensions which enclose a base plate of the upper rudder blade section and a cover plate of the lower rudder blade section, where each rudder blade section defines a nose strip and an end strip, where both end strips are aligned and where each nose strip is laterally offset from the longitudinal central line with one to a port and the other to a starboard direction, where a height of the lower rudder blade section is less than a height of the upper rudder blade section, and wherein the rudder blade is a balanced rudder.

2. The rudder arrangement of claim 1, wherein an offset central line drawn through a center of each of the laterally offset nose strips of the upper rudder blade section and the lower rudder blade section form an angle $\alpha$ with the longitudinal central line of at least 3° to 10°.

3. The rudder arrangement of claim 1, wherein a first curved arcuate side wall section of the upper rudder blade section located on either the port or starboard side has a shorter length than a third curved arcuate side wall section of the upper rudder blade section located on the opposite starboard or port side, and a second curved arcuate side wall section of the lower rudder blade section located on either the port or starboard side has a shorter length than a fourth curved arcuate side wall section of the lower rudder blade section located on the opposite starboard or port side.

4. The rudder arrangement of claim 3, wherein an arc length of the third curved arcuate side wall section is greater than an arc length of the first curved arcuate side wall section and an arc length of the fourth curved arcuate side wall section is greater than an arc length of the second curved arcuate side wall section, wherein a transition zone of the third and fourth curved arcuate side wall sections extending rectilinearly to the end strip and a transition zone of the first and third curved arcuate side wall sections extending rectilinearly to the end strip are offset in the direction of the end strip.

5. The rudder arrangement of claim 1, wherein the diameter of a hole in the upper rudder blade section for receiving a rudder pipe is smaller than a greatest profile thickness of the upper rudder blade section.

6. The rudder arrangement of claim 1, wherein the nose strip of the rudder blade facing the propeller is tapered compared to the end strip facing away from the propeller such that it forms an angle $\beta$ of at least 5° therewith.

7. The rudder arrangement of claim 6, wherein the angle $\beta$ is 10°.

8. The rudder arrangement of claim 1, wherein the area of a side wall surface of the lower rudder blade section is less than the area of a side wall surface of the upper rudder blade section.

9. The rudder arrangement of claim 6, wherein the end strips and nose strips are both downwardly tapered so as to form the angle β therebetween.

10. The rudder arrangement of claim 1, wherein each nose strip comprises a semicircular profile.

11. The rudder arrangement of claim 1, further comprising a rudder post extending downwardly from a hull of the ship and located within the upper rudder blade section.

12. The rudder arrangement of claim 11, wherein the rudder post is mounted in the rudder blade at a location of greatest profile thickness of the upper rudder blade section.

13. The rudder arrangement of claim 12, wherein the end strip is parallel to the rudder post.

14. The rudder arrangement of claim 1, wherein a first cross-sectional surface section of the upper rudder blade section in a region between the end strip and an area of greatest profile thickness of the rudder blade has a length which is equal to at least 1 and ½ times the length of a second cross-sectional surface section of the upper rudder blade section between the area of greatest profile thickness of the rudder blade and the nose strip, and wherein a third cross-sectional surface section of the lower rudder blade section in a region between the end strip and an area of greatest profile thickness of the rudder blade has a length which is equal to at least 1 and ½ times the length of a fourth cross-sectional surface section of the lower rudder blade section between the area of greatest profile thickness of the rudder blade and the nose strip.

15. The rudder arrangement of claim 1, wherein the upper rudder blade section on either the port or starboard side comprises a first curved arcuate side wall section and the lower rudder blade section on the opposite starboard or port side comprises a second curved arcuate side wall section both first and second curved arcuate side wall sections extending between the nose strip and the end strip, and wherein the first and second curved arcuate side wall sections are both comprised of a rectilinear side wall section, having a length L"2 defined between the end strip and an area of greatest profile thickness of the upper rudder blade section, and a length L'2 defined between the area of greatest profile thickness and the nose strip, where the length L"2 is at least ⅓ the length L'2.

16. The rudder arrangement of claim 15, wherein the lower rudder blade section on either the port or starboard side comprises a third curved arcuate side wall section and the lower rudder blade section on the opposite starboard or port side each comprises a fourth curved arcuate side wall section both third and fourth curved arcuate side wall sections extending between the nose strip and the end strip, and wherein the third and fourth curved arcuate side wall sections are comprised of a rectilinear side wall section having a length L"3 defined between the end strip and an area of greatest profile thickness of the lower rudder blade section, and a length L'3 defined between the area of greatest profile thickness and the nose strip, where the length L"3 is at least ⅓ the length L'3.

17. The rudder arrangement of claim 16, wherein the rectilinear side wall sections of all of the curved arcuate side wall sections are symmetrically configured having the same length and the same cross-sectional surface sections.

18. The rudder arrangement of claim 17, wherein a distance between the longitudinal center line and the first and second curved arcuate side wall sections is greater than a distance between the longitudinal center line and the third and fourth curved arcuate side wall sections.

19. The rudder arrangement of claim 11, wherein the rudder post is made of forged steel.

20. The rudder arrangement of claim 11, wherein the upper rudder blade section comprises a rudder pipe located at an area of greatest profile thickness, said rudder pipe mounted on the rudder post.

21. The rudder arrangement of claim 11, wherein the upper rudder blade section further comprises a rudder pipe located between the nose strip and an area of greatest profile thickness, said rudder pipe mounted on the rudder post.

* * * * *